United States Patent [19]

Kotturan

[11] 4,236,647

[45] Dec. 2, 1980

[54] CONTAINER FOR STERILE LIQUIDS

[76] Inventor: Paulson A. Kotturan, 520 N. 72nd Ave., Hollywood, Fla. 33024

[21] Appl. No.: 3,776

[22] Filed: Jan. 15, 1979

[51] Int. Cl.[3] ..... B65D 39/00

[52] U.S. Cl. ..... 215/247

[58] Field of Search ..... 215/11 E, 247, 248, 215/249, 307

[56] References Cited

U.S. PATENT DOCUMENTS

| | | | |
|---|---|---|---|
| 2,186,888 | 1/1940 | Tullar | 215/248 |
| 2,619,088 | 11/1952 | Saffir | 215/247 X |
| 2,846,103 | 8/1958 | Maxwell | 215/11 E |
| 3,136,440 | 6/1964 | Krug | 215/247 |

*Primary Examiner*—Donald F. Norton

*Attorney, Agent, or Firm*—Eugene F. Malin; Barry L. Haley; Philip R. Wadsworth

[57] ABSTRACT

A device for containing sterile liquids in such a manner so that said liquid may be incrementally dispensed from the device without contamination to the remaining liquid. More particularly, a bottle having an opening and having within it a flexible plastic bag connected to the bottle only at its opening. Said bottle opening being sealed by a rubber stopper which has a vent in it which allows air to flow from outside the container to the area between the bottle and the flexible bag. Thus when liquid is sucked out of the bag via a hollow needle inserted through the stopper, no vacuum is created for the bag collapses as air flows into the area between the bag and bottle.

4 Claims, 2 Drawing Figures

CONTAINER FOR STERILE LIQUIDS

BACKGROUND OF THE INVENTION

This invention relates to the field of containers and dispensers, and more particularly to devices capable of containing liquid and dispensing part of the contents without contamination of the remainder.

The prior art reveals numerous containers designed to prevent contamination of their contents. Many of these devices are able to successfully prevent contamination until some of their contents must be removed; however, during the removal of part of the contents the remainder is often contaminated by air which enters the container when it is opened or when air is injected into the container to prevent the formation of a vacuum which would impede the dispensing of the contents. Due to the novel design of the device presented herein it need not be opened or have air injected into it in order to have part of its contents removed. Thus the possibility of contamination from outside air is eliminated.

BRIEF SUMMARY OF THE INVENTION

A rigid container such as a glass bottle is sealed at one end by a stopper of suitable material such as rubber. A flexible plastic bag is positioned within said container and is attached along the rim of its open end to the outer circumference of said stopper at a point on the stopper which is well within said container. Thus the stopper seals the inside of the container from the outside environment while also sealing the area inside the bag from the outside environment. Simultaneously the area inside the bag is separated from the area outside the bag but inside the container. The stopper has an opening or vent in it which allows air to flow from the outside environment to the area outside the bag but inside the container.

In order to use the device a liquid which must remain sterile and separated from the atmosphere is placed in the flexible bag. The bag is attached along the rim of its open end to a stopper. The bag is then placed completely within a glass bottle and the stopper is forced into place in the bottle opening. In order to remove part of the liquid a hollow needle is forced through the stopper into the liquid in the bag. The liquid is sucked out through the needle and as the liquid is removed the bag is allowed to collapse due to the vent in the stopper which allows air to flow in between the bag and the bottle.

In accordance with the above described structure and operation it is the primary object of this invention to provide a device which allows a sterile liquid contained within it to be removed in part without contamination to the remaining liquid.

Another object is to provide such a device which can prevent a sterile liquid from becoming contaminated for a significant period of time.

Another object is to provide such a device which can hold a liquid and allow part of that liquid to be removed without any of the liquid coming in contact with the surrounding atmosphere.

Still another object is to present such a device which is economical and easy to use and manufacture.

These together with other objects and advantages will become apparent to those skilled in the art upon reading the details of construction and operation as more fully set forth hereinafter, reference being had to the accompanying drawings forming a part hereof, wherein like numerals refer to like parts throughout.

DETAILED DESCRIPTION OF PREFERRED EMBODIMENTS OF THE INVENTION

Before the present container is specifically described, it is to be understood that the invention is not limited to the particular arrangement of the parts here, as such devices may vary. It is also to be understood that the phraseology or terminology herein used is for purposes of description of particular embodiments and not of limitation, as the scope of the present invention is denoted by the appended claims.

Figure 1:
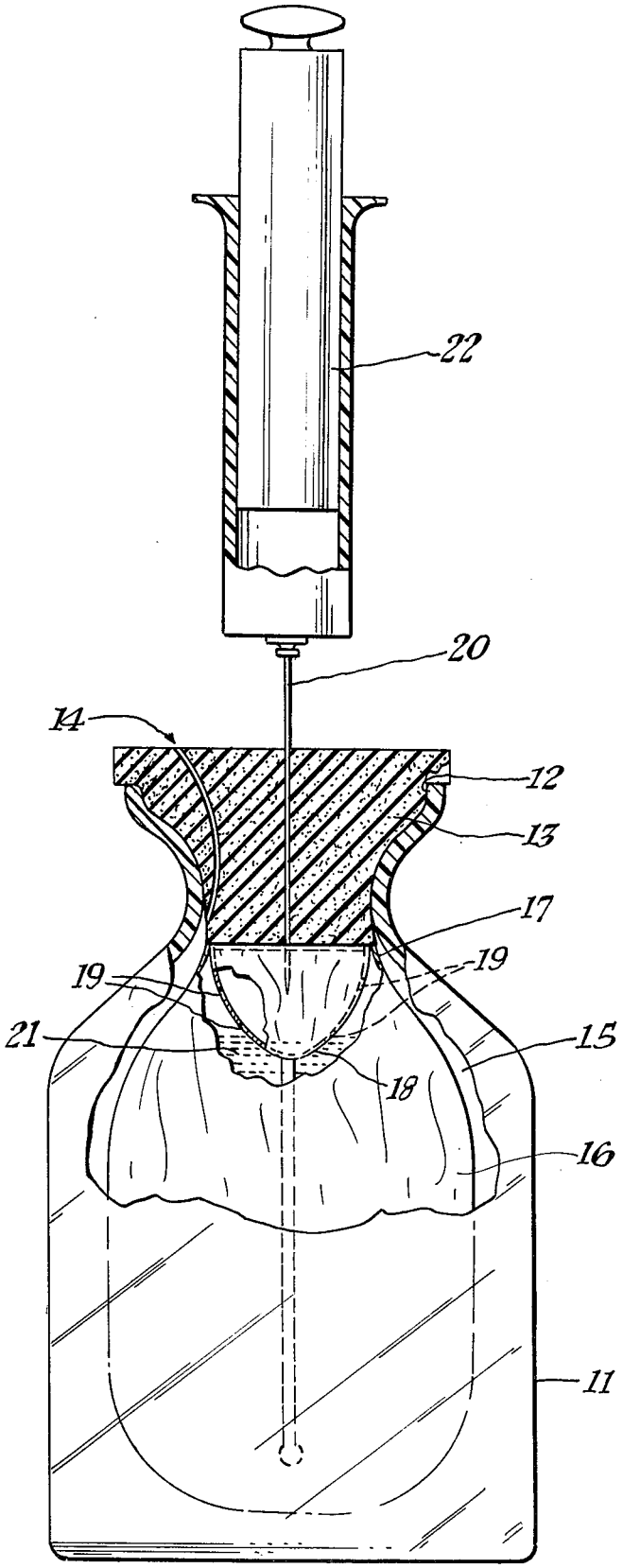
FIG. 1 is a cross-sectional view of the device.

Referring now to the drawings and to FIG. 1 in particular. A cross-sectional view of the device is shown. An outer rigid container 11 is composed of a suitable material such as clear glass. Container 11 has opening 12 in it which is plugged by stopper 13. The stopper 13 has an opening or vent 14 which leads from the outside to the area 15 inside the bottle 11 but outside the bag 16. The bag 16 is composed of a suitable flexible, inert, transparent material such as (PVC) polyvinylchloride. The upper rim 17 of the bag opening is connected to the stopper 13 at a point below the vent opening 14. A shield 18 having a multiplicity of holes 19 therein may be attached to the stopper 13 along with the upper rim 17 of the bag 16. The purpose of shield 18 is to prevent the needle 20 from puncturing the bag so that the liquid 21 contained in the bag could flow out.

It is possible to remove or add to the liquid 21 without exposing any of the liquid to the atmosphere. A hollow needle 20 which is connected to a suction creation device such as the syringe 22 is inserted through the stopper 13 as shown in FIG. 1. As liquid 21 is drawn out of the bag 16 the bag is allowed to collapse because air may enter container 11 via the vent 14.

Figure 2:
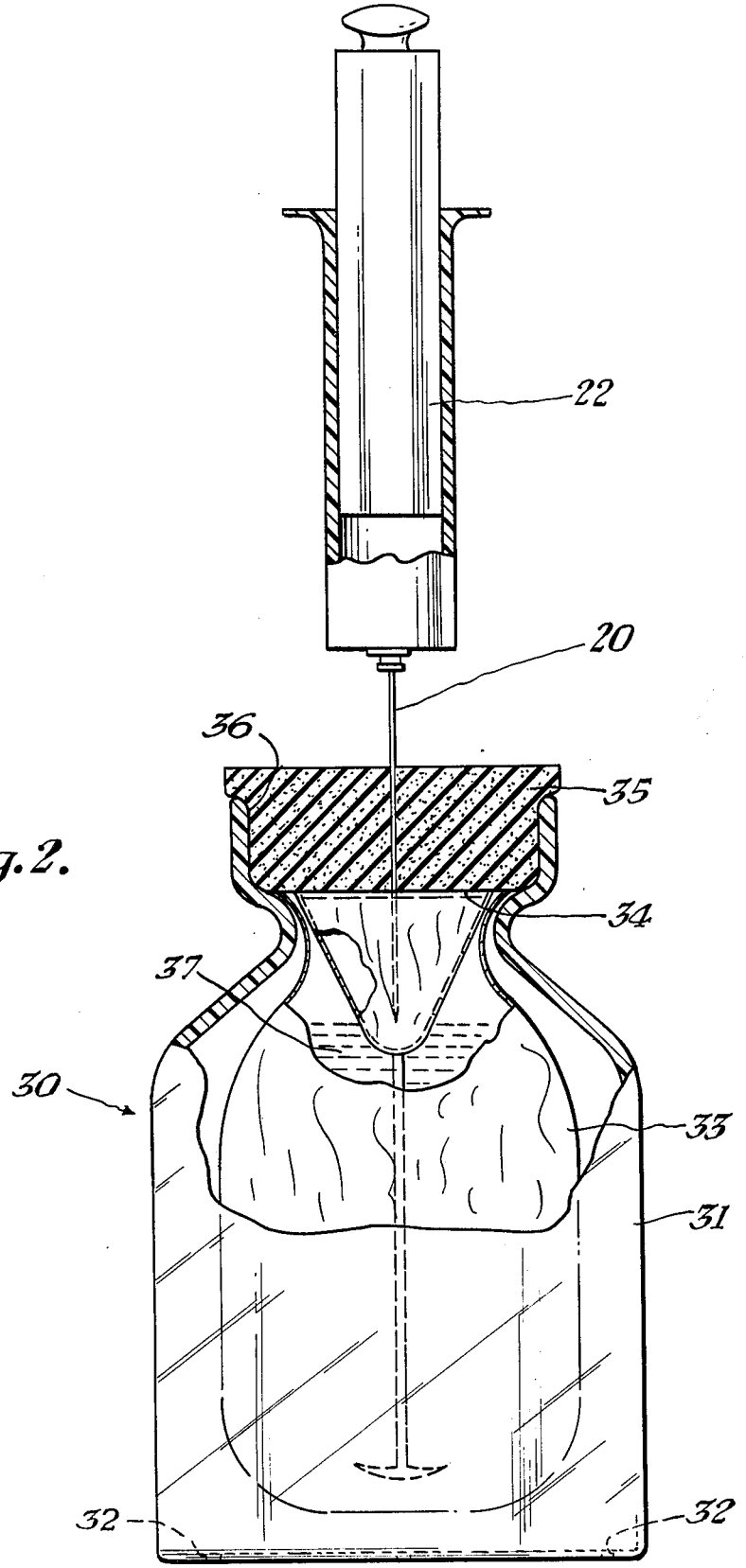
FIG. 2 is a cross-sectional view of a second embodiment of the device.

Referring now to FIG. 2. A cross-sectional view of another embodiment of the device 30 is shown. The outer rigid container 31 has openings 32 in it. A flexible plastic bag 33 is contained within container 31 and is connected to container 31 along the rim 34 of its opening. The stopper 35 plugs the opening 36 of container 31.

In order to remove or add liquid 37 from bag 33, a hollow needle 20 (as in FIG. 1) which is connected to syringe 22 is inserted through stopper 35. As liquid is drawn out of bag 33 it is allowed to collapse because of the air which can enter container 31 via openings 32. When the needle is removed from the stopper, the stopper seals itself due to the resiliency of the material which the stopper is composed such as natural or synthetic rubber.

The instant invention has been shown and described herein in what is considered to be the most practical and preferred embodiments. It is recognized, however, that departures may be made therefrom within the scope of the invention and that obvious modifications will occur to a person skilled in the art.

What I claim is:

1. A container, comprising:

an outer rigid container having an opening therein, a resilient stopper means for plugging said opening in said outer container, a flexible bag held within said rigid container, and a means for allowing the outer atmosphere to flow between the outer environment and the area between said outer container and said bag, and a shield means extending between said stopper and said bag, said shield means having a multiplicity of openings therein.

2. A container as recited in claim 1, wherein:

said outer container is composed of transparent glass, said stopper is composed of a resilient rubber, and said bag is composed of a flexible, inert, transparent plastic.

3. A container as recited in claim 2, wherein:

said means for allowing atmosphere to flow is an aperture in said stopper, said aperture extending from the outer environment to the area between said outer container and said bag.

4. A container as recited in claim 2, wherein:

said means for allowing atmosphere to flow is an aperture in said outer container, said aperture extending from the outer environment to the area between said outer container and said bag.

* * * * *